US006454100B1

(12) United States Patent
Yanagihara et al.

(10) Patent No.: US 6,454,100 B1
(45) Date of Patent: Sep. 24, 2002

(54) SEMICONDUCTOR ELEMENT CARRYING EQUIPMENT

(75) Inventors: Makoto Yanagihara, Kumamoto (JP); Masamitsu Shimasaki, Kumamoto (JP); Iwao Sakai, Kumamoto (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/976,035

(22) Filed: Oct. 15, 2001

(30) Foreign Application Priority Data

May 23, 2001 (JP) ..... 2001-154525

(51) Int. Cl.[7] ..... B07C 5/02
(52) U.S. Cl. ..... 209/539; 438/166
(58) Field of Search ..... 438/14, 166; 209/539; 29/832; 356/73

(56) References Cited

U.S. PATENT DOCUMENTS 4,200,393 A * 4/1980 Suzuki ..... 356/73
4,711,024 A * 12/1987 Russell ..... 29/832
5,500,824 A * 3/1996 Fink ..... 365/201
6,112,905 A * 9/2000 O'Connor ..... 209/539
6,162,667 A * 12/2000 Funai ..... 438/166

FOREIGN PATENT DOCUMENTS

JP A1 4-116134 10/1992

* cited by examiner

*Primary Examiner*—John F. Niebling
*Assistant Examiner*—Andre'C Stevenson
(74) *Attorney, Agent, or Firm*—Leydig Voit & Mayer, Ltd.

(57) ABSTRACT

A semiconductor element carrying apparatus for surely recovering semiconductor elements dropped in the environs of an electric driver. A lower base member is disposed under a carrying inlet, an inspecting part and a carrying outlet for semiconductor elements, such as semiconductor integrated circuit devices. On the lower base member, an electric driver cover covering an electric driver and a collector is disposed for collecting the semiconductor elements dropped. The semiconductor elements dropped on the electric driver cover are guided to the collector. The collector is equipped with a collector outlet, and a semiconductor collecting vessel is arranged under the collector outlet. Furthermore, an air blower blows compressed air along a slope from a nozzle to move dropped semiconductor devices.

5 Claims, 2 Drawing Sheets

SEMICONDUCTOR ELEMENT CARRYING EQUIPMENT

BACKGROUND OF THE INVENTION

1. Technical field

The present invention relates to a semiconductor element carrying equipment and more particularly, to a semiconductor element carrying equipment for surely capturing and collecting a semiconductor element dropped from a carrying line including work stages, such as stages inspecting the semiconductor elements.

2. Background Art

A semiconductor integrating circuit device (IC) includes one or plural semiconductor chips fabricated with plural electrical circuit elements therein. The IC has plural lead wires constructed for installing on a circuit board such as a printed circuit board. An inspecting process is included in a manufacturing process of IC, and a work stage for inspecting an appearance of the lead wires of IC is included in the inspecting process. A work stage for inserting and extracting the lead wires of IC to and from a test socket is also included in the inspecting process. In these work stages as mentioned above, a carrying line is installed, and IC is carried into or taken out of the carrying line and inserted into or extracted from the test socket for inspecting along the carrying line. In carrying IC, for example, a vacuum adsorption tool for adsorbing IC is used wherein some ICs may drop from the carrying line due to a failure in carrying caused by an inadequate adsorption.

Generally, it is not easy for the workers to find and recover ICs dropped from the carrying line, and a shortage in a total number of ICs inspected could occur with dropped ICs left in an inspector or in an inserting and extracting machine. In this case, IC dropped is recoverable when the worker finds it. However, there are some problems such that a possibility wherein ICs mixed with those of a different type are carried to the following process, as it is a general practice to use the common inspecting machine for the same package with the different type of ICs.

A prior art of a testing machine for IC to cope with the problems is disclosed in Japanese laid open patent No.11-116134. The testing machine according to the prior art is one wherein IC to be tested supplied continuously from a magazine are distributed at the distributing part to a testing part along the plural guide rails, tested according to a predetermined procedure at the testing part and stored into the magazine after being classified as a good or a bad element based on a test result. An exterior cover of a machine room comprising the distributing part of IC is composed of the first cover and the second cover wherein the first cover with a transparent window mainly covers a bottom side of the machine room, the second cover mainly covers a front side of the machine room and an opening for taking out dropped IC is installed in the machine room between the first cover and the second cover. Furthermore, in a configuration of the testing machine for IC, a drawer is installed to recover dropped IC at the bottom of the machine room composing the distributing part. Based on the testing machine for IC, check and recovery of ICs dropped into the machine room can be easily realized.

The testing machine for IC as above mentioned in Japanese laid open patent No. 11-116134 is configured wherein only ICs dropped to the first cover are recoverable out of entire ICs dropped to a supply gate side from a hole of the distributing part. However, the testing machine, in general, is equipped with an electric driver such as a power transformer, and it is especially difficult to find dropped IC in a surrounding area of the electric driver. Thus, the testing machine for IC according to the prior art has no provisions to cope with insure and inadequate recovery of ICs in the environs of the driver.

SUMMARY OF THE INVENTION

In view of the above, it is the object of the present invention to provide a semiconductor element carrying equipment, wherein the semiconductor element dropped from a carrying line, which including at least one work stage, to the places inducing the environs of a driver is securely captured and recovered.

The semiconductor element carrying equipment according to the present invention carries semiconductor elements along a carrying line including at least one-work stage, the semiconductor element carrying equipment comprises:

a lower base member installed under the carrying line, an electric driver installed on the lower base member for applying an electric power at least to the work stage, an electric driver cover for covering the electric driver and, a collector installed under the carrying line for collecting the semiconductor element dropped from the carrying line, wherein a slope surface is formed on the electric driver cover and the slope surface guides the semiconductor element dropped on the electric driver cover to the collector.

Furthermore, the semiconductor element carrying equipment according to the present invention is featured wherein the semiconductor element is a semiconductor integrated circuit[]t device with plural lead wires and the work stage is an external appearance inspecting stage for inspecting the appearance of the lead wires of the semiconductor integrated circuit device.

Furthermore, the semiconductor element carrying equipment according to the present invention is featured wherein the semiconductor element is a semiconductor integrated circuit device including plural circuit elements and plural lead wires, and the work stage is an inserting and extracting stage for inserting the leads wires of the semiconductor integrated circuit device to a socket for inspecting an electric circuit of the semiconductor integrated circuit device, and for extracting the lead wires from the socket.

Furthermore, the semiconductor element carrying equipment according to the present invention is featured wherein the collector has a slope for guiding the semiconductor element dropped from the carrying line to a collector outlet and a semiconductor element collecting vessel installed at the outlet.

Furthermore, the semiconductor element carrying equipment according to the present invention is featured wherein the collector has the slope for guiding the semiconductor element dropped from the carrying line to a collector outlet and a nozzle for blowing an air toward the collector outlet along the slope.

The semiconductor element carrying equipment according to the present invention has the following effects.

The semiconductor element carrying equipment is configured with the lower base member installed under the carrying line including at least one work stage, an electric driver for supplying an electric power at least to the work stage, an electric driver cover for covering the electric driver and a collector installed under the carrying line for collecting the semiconductor element dropped from the carrying line. Moreover, as a slope surface is formed on the electric driver cover and the slope surface guides the semiconductor element dropped on the electric driver cover to the collector, then the semiconductor element dropped into the environs of the electric driver can be easily found and securely recovered Furthermore, dropped semiconductor element from the carrying line is easily found and recovered in the same manner as mentioned above regardless of whether or not the work stage is the appearance inspecting stage for inspecting the lead wires of the semiconductor integrated circuit device or the inserting and extracting stage of the lead wires of the semiconductor integrated circuit device using the socket for testing the electrical circuits of the semiconductor integrated circuit device.

Furthermore, by forming the slope on the collector for guiding dropped semiconductor element to the collector outlet, the semiconductor element dropped from the carrying line to the places such as the environs of the driver is securely and easily recovered.

Furthermore, by installing the nozzle for erupting the compressed air to the collector outlet along the slope of the collector, the semiconductor element hanging or hooking on the way during dropping from the carrying line is forced to be guided to the collector outlet for surer recovery.

DETAILED DESCRIPTION OF THE PREFERRED EMBODIMENT

Figure 1:
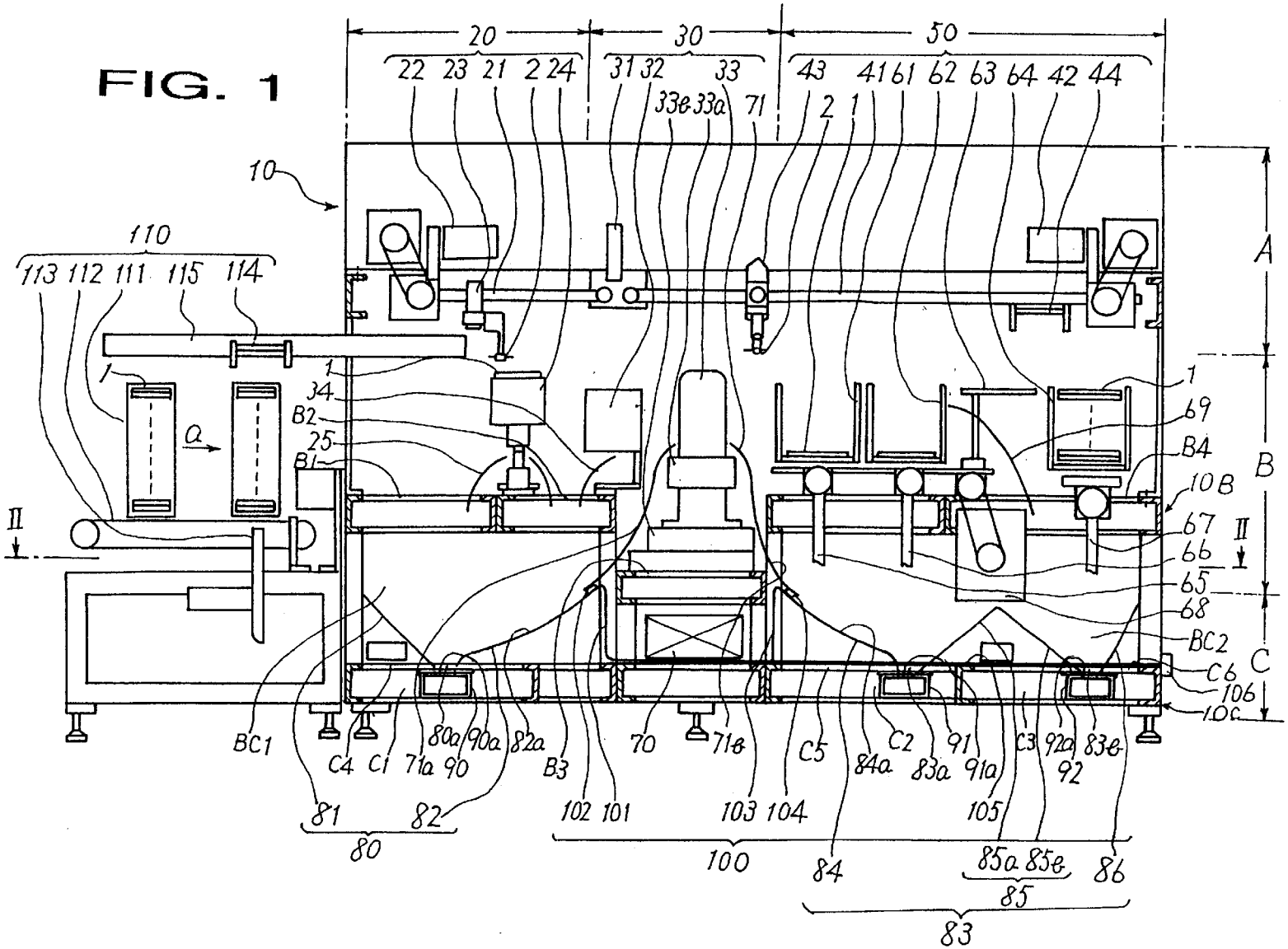
FIG. 1 shows a main cross section of an appearance inspecting machine for a semiconductor element having a semiconductor element carrying equipment in an embodiment 1 according to the present invention.
Figure 2:
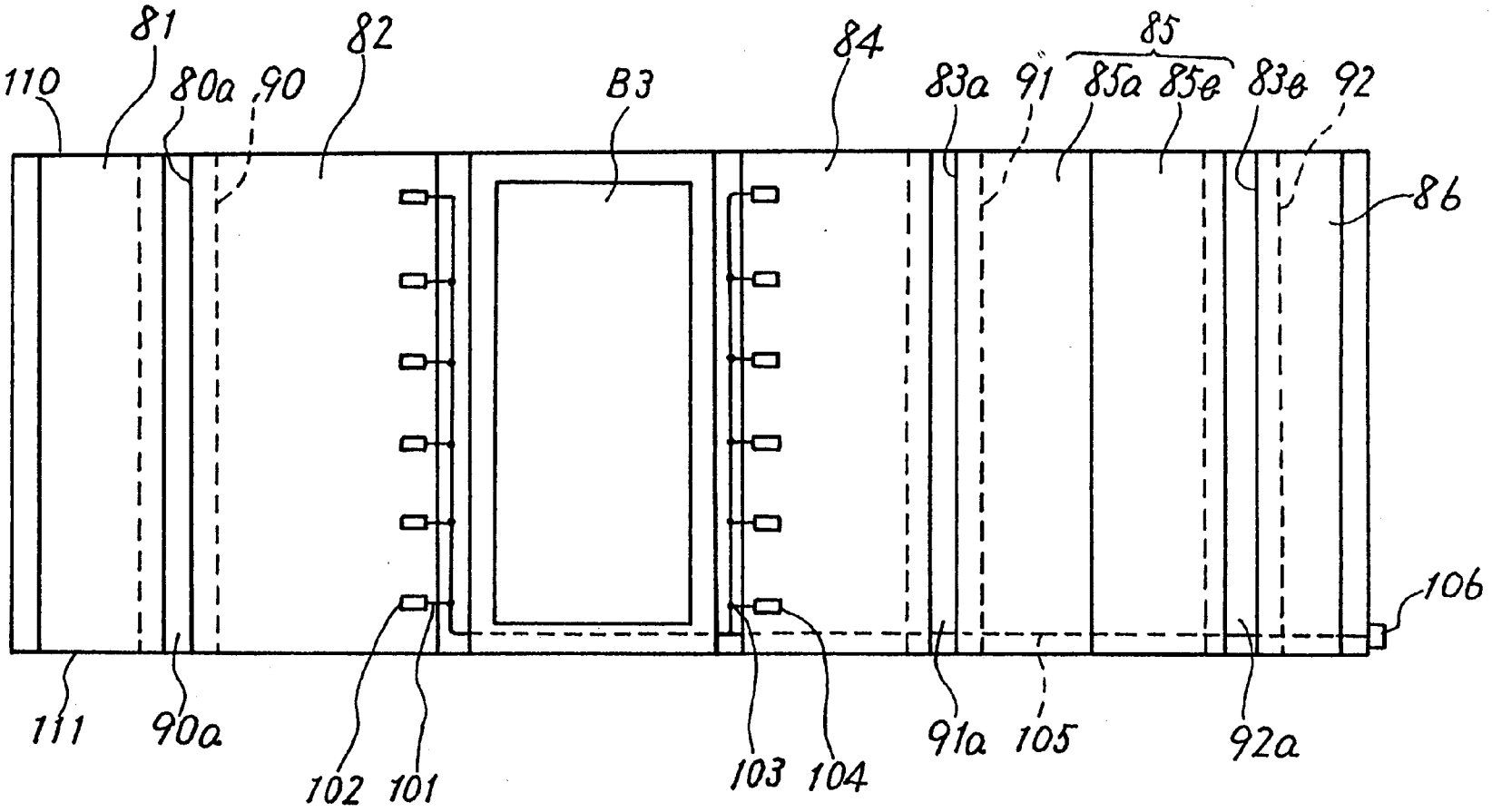
FIG. 2 is a plan view taken along line II—II of FIG. 1.

Hereafter, an embodiment of the present invention is explained based on the drawings. FIG. 1 shows a semiconductor element carrying equipment in an embodiment 1 according to the present invention. Namely, the embodiment 1 is a side view of an appearance inspecting machine for the semiconductor element shown as a main part cross section adopting the semiconductor element carrying equipment according to the present invention. And FIG. 2 is a plane drawing of a main part of FIG. 1 seen from a direction of II—II line.

The appearance inspecting machine shown in FIG. 1 is for inspecting a semiconductor element such as for the semiconductor integrated circuit device (IC), and comprises a main body 10 of the appearance inspecting machine and a tray carrying inlet part 110 wherein IC to be inspected are carried in on a tray into the main body 10 of the appearance inspecting machine.

The main body 10 of the appearance inspecting machine as shown in FIG. 1 is provided with a carrying inlet part 20 for IC on the upper left side, an inspecting part 30 for IC on the upper middle portion and an carrying outlet part 50 for IC on the upper fight side wherein these parts 20, 30 and 50 comprises three layers such as an upper layer A, an intermediate layer B and a lower layer C. The inspecting part 30 includes a first measuring part 31 and a second measuring part 33 which constitute a work stage. And the carrying inlet part 20 and the carrying outlet part 50 have a carrying line 21 and a carrying line 41 respectively for carrying in and carrying out the semiconductor element.

An outlined explanation of the appearance inspecting machine is made in the following. hi the upper layer A, the carrying line 21 of the carrying inlet part 20, the first measuring part 31 of the inspecting part 30 and the carrying line 41 of the carrying outlet part 50 are arranged. The intermediate layer B is configured on an intermediate base member 10B wherein a tray setting stand 24, an inspecting stand 32 and the second measuring part 33 of the inspecting part 30, a carrying out tray magazine 61 and 62, a tray setting stand 63 and an emptied carrying out tray magazine 64 of the carrying outlet part 50 are arranged on the intermediate base member 10B. Furthermore, the lower layer C is configured on the lower base member 10C wherein a collector 80, 83, an electric driver part 70, an electric driver cover 71 and a blowing air supplying part 100 are arranged on the lower base member 10C.

A detailed explanation of the appearance inspecting machine is made in the following. The carrying inlet part 20 for IC has a geared motor 22, an adsorbing tool 23 and a tray setting stand 24 in addition to the carrying line 21 wherein the carrying line 21 is a rotating axis with a spiral ditch around itself to be driven by the geared motor 22. The adsorbing tool 23 meshes with the spiral ditch of the rotating axis 21, and is carried in a direction of the axis driven by a rotation of the rotating axis 21. The adsorbing tool 23 is configured to adsorb IC with a vacuum wherein the tool adsorbs IC 2 on the tray setting stand 24, carries IC 2 toward the inspecting stand 32 and places IC 2 on the inspecting stand 32.

The inspecting part 30 has the inspecting stand 32 and the second measuring part 33 in addition to the first measuring part 31. More in detail, the first measuring part 31 is located at an upper side of the inspecting stand 32, and inspects a printed mark of IC 2 placed on the inspecting stand 32. The second measuring part 33 is arranged for inspecting items such as the flatness of the plural lead wires of IC 2.

The carrying outlet part 50 has a geared motor 42, an adsorbing tool 43, a carrying out tray magazine 61, 62, a tray setting stand 63, the emptied carrying out tray magazine 64 and a tray damper 44 in addition to the carrying line 41. The carrying line 41 is a rotating axis with a spiral ditch around itself to be driven by a geared motor 42. The adsorbing tool 43 meshes with the spiral ditch of the rotating axis 41, and is carried in a direction of the axis driven by a rotation of the rotating axis 41. The adsorbing tool 43 is configured to adsorb IC 2 with a vacuum wherein the adsorbing tool 43 adsorbs IC 2 with the mark inspection finished, and carries IC 2 toward the second measuring part 33. Then, IC 2 is inspected in its flatness of the lead wires or other items by the second measuring part 33 in a state wherein IC 2 is being adsorbed by the adsorbing tool 43.

After the inspection of the flatness or other items is finished, IC 2 with the inspection finished is transferred to the carrying out tray magazine 61,62 and the tray setting stand 63 by the adsorption tool 43. Then, IC 2 with the inspection finished is placed on anyone tray 1 of the carrying out tray magazine 61,62 and the tray setting stand 63 based on the predetermined criteria according to the inspected results of the first measuring part 31 and the second measuring part 33. Under the carrying out tray magazine 61 and 62, a pushing up tool 65 and 66 are respectively installed for pushing up the tray 1 housed in each carrying out tray magazine. A pushing up tool 67 is for pushing up the tray 1 housed in the emptied carrying out tray magazine 64 (the driving part is not shown). When each tray 1 of the crying out tray magazine 61,62 and the tray setting stand 63 is filled with inspected IC 2, the tray 1 of the carrying out tray magazine 61 and 62 is respectively pushed up by the pushing up tool 65 and 66, and the tray 1 of the carrying out tray magazine 61, 62 and the tray setting stand 63 is carried to the outside of the main body 10 of the appearance inspecting machine tray by tray from their top position. And at this time, the tray 1 in the emptied carrying out tray magazine 64 is pushed up by the pushing up tool 67. And the tray damper 44 is driven wherein the tray 1 emptied at the top position of the emptied carrying out tray magazine 64 is clamped to be carried one by one for stocking to the carrying out tray magazine 61,62 and the tray setting stand 63 wherein the tray 1 of the carrying out tray magazine 61,62 and the tray setting stand 63 is cleared beforehand by the tray damper 44. Here, a carrying out magazine driving part 68 is for driving the carrying out tray magazine 61, 62 and the tray setting stand 63 to move into the rectangular direction to the intermediate base member 10B.

The tray carrying inlet part 110 as the preceding stage of the main body 10 of the appearance inspecting machine is installed at the front stage of the carrying inlet part 20 of the main body 10 of the appearance inspecting machine. More in detail, the tray carrying inlet part 110 comprises a magazine 111 laden with ICs not yet inspected, a belt conveyor 112, a pushing up tool 113, a tray damper 114 and a damper carrying line 115. The magazine 111 is transferred by a belt conveyor 112 into the direction marked as an arrow until the predetermined position is reached, and then the tray 1 in the magazine 111 is pushed up by the pushing up tool 113. The pushing up motion entails a driving of the tray clamper 114 (the driving part is not shown) wherein the tray clamper 114 clamps the tray 1 at the top position in the magazine 111 for carrying the tray 1 along the damper carrying line 115 toward the carrying inlet part 20 of the main body 10 of the appearance inspecting machine, and then the tray 1 is placed on the tray setting stand 24.

As heretofore mentioned, in the carrying lines of the appearance inspecting machine 10, the tray damper 114 clamping the tray 1 laden with ICs to be inspected repeats carrying and releasing of the tray 1. Moreover, the adsorbing tool 23 and 24 repeats adsorbing with a vacuum, carrying and releasing of ICs.

In these functioning procedures, IC under being carried may drop from the carrying lines when there are malfunctions such as a decrease in a degree of vacuum or a bad contact condition between an adsorbing tip of the adsorbing tool and an IC package. When some ICs drop into the main body 10 of appearance inspecting machine while the machine is operating, it is usually difficult to find and recover them, and accordingly, the deficiency of the numbers of IC takes place during the inspection. In this case, as the same inspecting machine is generally used for IC having the same package with a different type, a mixture of ICs with the different type may be carried into the following process even when IC dropped can be luckily found. To prevent these shortcomings from occurring, the collector 80, 83, the driver cover 71 and the blowing air supplying part 100 are installed The detailed configuration and the effect are to be explained hereafter.

The lower base member 10C is a constructive assembly configured with a combination of a ditch shaped steel and has an internal space C1,C2 and C3 wherein an opening C4,C5 and C6 are formed respectively in the internal space Cl, C2 and C3, and the opening C4, C5 and C6 are piercing the lower base member 10C in a vertical direction. Similarly, the intermediate base member 10B is a constructive assembly configured with a combination of a ditch shaped steel and has an opening B1,B2,B3 and B4, and the opening B1, B2, B3 and B4 are piercing the intermediate base member 10B in a vertical direction. Furthermore, a space BC1 is formed just on a left side of the electric driver part 70 in a bottom section of the carrying inlet part 20 for IC between the intermediate base member 10B and the lower base member 10C. Similarly, a space BC2 is formed just on a right side of the electric driver part 70 in a bottom section of the carrying outlet part 50 for IC between the intermediate base member 10B and the lower base member 10C.

The collector 80 installed under the carrying inlet part 20 comprises a combination of two slant panels wherein a collector outlet 80*a* is formed between the slant panel 81 and 82. Concretely, the slant panel 81 is installed in the space BC1 formed at the bottom of the carrying inlet part 20 and is slanting from an upper left part of the space BC1 to the collector outlet 80*a* Similarly, the slant panel 82 is installed in the space BC1 slanting from an upper light part of the space BC1 to the collector outlet 80*a*. Consequently, the slant panel 81 and 82 are installed slanting in a reverse direction each other over the entire space of the lower part of the space BC1 at the bottom of the carrying inlet part 20 wherein the collector outlet 80a is formed between the slant panel 81 and 82. The collector outlet 80*a* is installed in the opening C4 of the lower base member 10C at the bottom of the space BC1. The slant panel 81 and 82 of the collector 80 guides IC2 dropped from the carrying line 21 to the collector outlet 80*a*.

Furthermore, the collector 83 is a combination of a slant panel 84 and 86 on both ends and a slant panel 85 in the middle with a mountain shaped cross section wherein an collector outlet 83*a* is formed between the slant panel 84 and 85 and an collector outlet 83*b* is formed between the slant panel 85 and 86. Concretely, the slant panel 84 is installed in the space BC2 formed at the bottom of the carrying outlet part 50 and is slanting from an upper left part of the space BC2 to the collector outlet 83*a*. The slant panel 85 comprises a slanting part 85*a* and 85*b*. The slanting part 85*a* is installed slanting from an upper middle of the space BC2 to the collector outlet 83*a*, and similarly, the slanting part 85*b* is installed slanting from an upper middle of the space BC2 to the collector outlet 83*b*. Furthermore, the slant panel 86 is installed slanting from an upper right of the space BC2 to the collector outlet 83*b*. In this way, the slant panels are installed over both ends of the space BC2. Consequently, the slant panel 84,the slanting part 85*a* and 85*b* of the slant panel 85 and the slant panel 86 are installed slanting mutually opposite in direction over the entire space of the space BC2. And the collector outlet 83*a* is formed between the slant panel 84 and the slanting part 85*a*, and the collector outlet 83*b* is formed between the slanting part 85*b* and the slant panel 86. The collector outlet 83*a* and 83*b* are installed respectively in the opening C5 and C6 of the lower base member 10C at the bottom of the space BC2. IC dropped from the carrying line to the slant panel 84,85 or 86 is guided to the collector outlet 83*a* or 83*b*.

FIG. 2 is a plane drawing of the main parts showing the arrangement of the slant panel 81,82,84,85 and 86 corresponding to the II—II line in FIG. 1. The main body 10 of the appearance inspecting machine has an outside wall 110 and 111 facing each other wherein each slant panel of the slant panel 81,82,84,85 and 86 is extending to span the outside wall 110 and 111. Consequently, each slant panel as mentioned above is installed over the entire space at the bottom of the space BC1 and BC2 between the outside wall 110 and 111 with facing each other. Moreover, in the internal space C1, C2 and C3 of the lower base member 10C, an IC collecting vessel 90, 91 and 92 respectively having an opening 90*a*, 91*a* and 92*a* on top of each IC, collecting vessel are installed wherein each IC collecting vessel for dropped IC is installed capable of being drawn out in a direction perpendicular to the outside wall 110 and 111. The collector outlet 80*a* of the collector 80 and the collector outlet 83*a* of the collector 83 respectively correspond to the opening 90*a* of the IC collecting vessel 90 and the opening 91*a* of the IC collecting vessel 91. Furthermore, the collector outlet 83*b* of the collector 83 corresponds to the opening 92*a* of the IC collecting vessel 92. In his way, dropped ICs collected by the collector 80 and 83 are stored in the IC collecting vessel 90, 91 and 92.

The electric driver part 70, at least, includes a power transformer for applying required voltage to the second measuring part 33 and to other devices such as a controlling driver (not shown) for controlling the functions of the electric driving part 70. The electric driver cover 71 is configured to cover the electric driver 70 wherein the electric driver cover 71 prevents dropped IC 2 of the carrying line 21 and 41 from entering into the upper part or the environs of the electric driver part 70 through an opening B3 of the intermediate base member 10B. At the same time, the electric driver cover 71 prevents dropped IC 2 from being caught by a projected part 33*a* of the second measuring part 33 and a projected part 33*b* of a fitting part of the second measuring part 33. The electric driver cover 71 has a slope surface 71*a* and 71*b* around itself wherein a bottom part of the slope surface 71*a* and 71*b* is respectively installed to overlap the slant panel 82 of the collector 80 and the slant panel 84 of the collector 83. Consequently, IC 2 dropped on the electric driver cover 71 is guided from the slope surface 71*a* and 71*b* to the slant panel 82 and 84 and then into the IC collecting vessel 90 or 91 for storage.

A place around the electric driver part 70 is especially difficult for a worker to find dropped IC, as the place is congested with such as the lead wires for controlling the electric driver part 70. Therefore, dropped IC is surely prevented from entering into the place by covering the place with the electric driver cover 71. In the same manner, by combining the collector 80 and 83 with electric driver cover 71 under the carrying lines of the carrying inlet part 20 for IC, the inspecting part 30 and the carrying outlet part 50, IC dropped directly from the carrying lines to the collector 80, and 83 as well as IC dropped from the carrying lines to the environs of the electric driver part 70 are both guided to the collector outlet 80*a*, 83*a* and 80*b* of the collector 80 and 83, and then gathered into the IC collecting vessel 90,91 and 92 to be recovered.

Moreover, a guide cover 25 is installed to the tray setting stand 24 to prevent IC dropped to the projected part including the fitting part of the stand from hooking, and smoothly guides dropped IC to the opening B1 and B2. For the same purpose, a guide cover 34 is installed to the inspecting stand 32 for guiding dropped IC to the opening B2. Similarly, a guide cover 69 is installed to a carrying out magazine driving part 68 to guide dropped IC on the guide cover 69 to the opening B4. In this way, by installing the guide cover 25,34 and 69, dropped IC is smoothly guided to the collector 80 and 83 without being caught by the projected part during dropping, and dropped IC is surer to be recovered.

A blowing air supplying part 100 is configured with a combination of a nozzle 102, 104, an air inlet plumbing 101,103, a common air inlet plumbing 105 and an electromagnetic valve 106. More concretely, as shown in FIG. 1 and FIG. 2, a nozzle 102 composing of a set of six nozzles is arranged at the upper end of the slant panel 82 to erupt air along the slope 82*a* of the slant panel 82 wherein the nozzle 102 is connected to the air inlet plumbing 101 for introducing the compressed air. Similarly, the nozzle 104 composing of a set of six nozzles is arranged at the upper end of the slant panel 84 to erupt air along the slope 84*a* wherein the nozzle 104 is connected to the air inlet plumbing 103 for introducing the compressed air. The common air inlet plumbing 105 installed on the lower base member 10C is connected to the air inlet plumbing 101 and 103. Furthermore, the electromagnetic valve 106 is connected to the opposite end of the common air inlet plumbing 105 wherein the electromagnetic valve 106 is fixed to the end of the lower base member 10C.

In the configuration of the blowing air supplying part 100 as shown above, the compressed external air is taken in through the electromagnetic valve 106 driven by a controller (not shown) intermittently. Accordingly, the compressed air erupts intermittently from the nozzle 102 and 104. By the intermittent eruption of the compressed air from the nozzle 102 and 104, dropped IC hooking on the slope 82*a* and 82*b* respectively of the slant panel 82 and 84 are forced to slide down into the collector outlet 80*a* and 83*a*.

In the embodiment 1 according to the present invention, the slant panel 81, 82 84, 85 and 86 are combined to be installed to make up the collector 80 having the collector outlet 80*a* and the collector 83 having both the collector outlet 83*a* and 83*b*. However, the same effect is also obtainable wherein a group of the slant panel 81 and 82 and a group of the slant panel 84, 85 and 86 are respectively unified to form a funnel shaped outlet at the bottom of each collector. Furthermore, in the embodiment 1 as shown heretofore, the electric driver cover 71 is unified to cover the electric driver part 70 , the projected part 33*a* and the fitting part 33*b* of the second measuring part 33. However, the same effect is possible even when the electric driver cover 71 is configured with a combination of the plural separate covers if required Moreover, in the embodiment 1, although the nozzle 102 and 104 of the blowing air supplying part 100 corresponding respectively to the slant panel 82 and 84 are arranged, the configuration can be modified for the nozzles to be installed to other slant panels such as the slant panel 81, 85 and 86 to the same effect if required. In addition, the number of a set of the nozzle 102 and 104 can be changed according to the requirement.

Furthermore, the embodiment 1 according to the present invention is described relating to the appearance inspecting machine for IC equipped with the carrying lines. However, the technological idea disclosed in the embodiment 1 is not limited to the external appearance inspector but can be applied to other machines such as an inserting and extracting machine for IC wherein the lead wires of IC is inserted into and extracted from a socket fabricated in a burn in board and is replaced onto a tray for IC to be electrically tested. In this case, the work stage is the inserting and extracting machine wherein IC is inserted into and extracted from the machine. For this work stage, as in the embodiment 1, a main body of the inserting and extracting machine is equipped with a carrying in line and a carrying out line for IC wherein dropped IC from the carrying lines can be effectively collected by installing the collector 80, 83, the electric driver cover 71, the IC collecting vessel 90, 9l and 92.

What is claimed is:

1. A semiconductor element carrying apparatus for carrying semiconductor elements along a carrying line including at least one work stage, the semiconductor element carrying apparatus comprising:

a lower base member located under the carrying line, an electric driver on said lower base member for applying electric power at least to the work stage, an electric driver cover covering said electric driver, and a collector under said carrying line for collecting semiconductor elements dropped from the carrying line, wherein said electric driver has a sloped cover guiding semiconductor elements dropped to said collector.

2. The semiconductor element carrying equipment claimed in claim 1, wherein the semiconductor element is a semiconductor integrated circuit device with plural lead wires and the work stage is an appearance inspecting stage for inspecting appearance of the lead wires of the semiconductor integrated circuit device.

3. The semiconductor element carrying equipment claimed in claim 1, wherein the semiconductor element is a semiconductor integrated circuit device including plural circuit elements and plural wires, and the work stage is an inserting and extracting stage for inserting the lead wires of the semiconductor integrated circuit device into a socket for testing an electric circuit of the semiconductor integrated circuit device, and for extracting the lead wires from the socket.

4. The semiconductor element carrying equipment claimed in claim 1, wherein said collector has a slope for guiding semiconductor elements dropped from the carrying line to a collector outlet and including a semiconductor element collecting vessel at said collector outlet.

5. The semiconductor element carrying equipment claimed in claim 1, wherein said collector has a slope for guiding semiconductor elements dropped from the carrying line to a collector outlet and a nozzle for blowing air toward said collector outlet along the slope.

* * * * *